US009706286B1

(12) United States Patent
Patel et al.

(10) Patent No.: US 9,706,286 B1
(45) Date of Patent: Jul. 11, 2017

(54) HEADPHONE RETENTION MECHANISM

(71) Applicant: Oculus VR, LLC, Menlo Park, CA (US)

(72) Inventors: Nirav Rajendra Patel, San Francisco, CA (US); Julian James Hammerstein, Atherton, CA (US)

(73) Assignee: Oculus VR, LLC, Menlo Park, CA (US)

( * ) Notice: Subject to any disclaimer, the term of this patent is extended or adjusted under 35 U.S.C. 154(b) by 0 days.

(21) Appl. No.: 15/017,546

(22) Filed: Feb. 5, 2016

Related U.S. Application Data

(60) Provisional application No. 62/273,816, filed on Dec. 31, 2015.

(51) Int. Cl.

| | |
|---|---|
| ***H04R 1/02*** | (2006.01) |
| ***H04R 9/06*** | (2006.01) |
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| ***H04R 1/10*** | (2006.01) |
| ***H04R 1/06*** | (2006.01) |

(52) U.S. Cl.
CPC ..... *H04R 1/105* (2013.01); *H04R 1/028* (2013.01); *H04R 1/06* (2013.01); *H04R 1/1016* (2013.01); *H04R 1/1033* (2013.01)

(58) Field of Classification Search
CPC ..... H04R 1/105; H04R 5/0335; H04R 5/033; H04R 1/10; G02B 27/017
USPC ..... 381/333, 87, 367, 361, 364, 340, 376, 381/374
See application file for complete search history.

(56) References Cited

U.S. PATENT DOCUMENTS

| | | | | |
|---|---|---|---|---|
| 6,369,952 B1 * | 4/2002 | Rallison | G02B 27/017 | 359/630 |
| 9,142,062 B2 * | 9/2015 | Maciocci | G06F 3/011 | |
| 2015/0100179 A1 * | 4/2015 | Alaniz | A63F 13/00 | 701/1 |
| 2016/0249124 A1 * | 8/2016 | Drinkwater | G02B 27/0176 | |

* cited by examiner

*Primary Examiner* — Thjuan K Addy
(74) *Attorney, Agent, or Firm* — Perkins Coie LLP

(57) ABSTRACT

A head-mounted display assembly with a headphone retention mechanism. The head-mounted display assembly includes a display housing, a headphone assembly, a headphone storage region located on the body of the display housing, and a headphone retention mechanism at the headphone storage region. The headphone retention mechanism includes a magnetic element configured to produce a magnetic field that releasably retains the headphone assembly against the headphone storage region when a user positions the headphone assembly in the vicinity of the headphone storage region.

20 Claims, 6 Drawing Sheets

HEADPHONE RETENTION MECHANISM

CROSS-REFERENCE TO RELATED APPLICATION

This application claims the benefit of and priority to U.S. Provisional Patent Application No. 62/273,816, titled Headphone Retention Mechanism, filed Dec. 31, 2015, which is incorporated herein in its entirety by reference thereto.

TECHNICAL FIELD

This application relates generally to audio headphones, and in particular to headphone retention mechanisms and associated assemblies, including earbud retention mechanisms for use with head-mounted displays.

BACKGROUND

Virtual-reality head-mounted displays have wide applications in various fields, including engineering design, medical surgery practice, military simulated practice, and video gaming. For example, a user wears a virtual-reality head-mounted display integrated with audio headphones while playing video games so that the user can have an interactive experience in an immersive virtual environment. It may be difficult for a user to properly adjust and comfortably wear the head-mounted displays and the integrated audio systems using the existing technology, which may negatively affect the user's experience.

BRIEF DESCRIPTION OF THE DRAWINGS

For a better understanding of the various described embodiments, reference should be made to the Detailed Description below, in conjunction with the following drawings. Like reference numerals refer to corresponding parts throughout the figures and descriptions.

DETAILED DESCRIPTION

Overview

A magnetic earbud retention mechanism is disclosed for use with a Mobile VR head-mounted display that holds a mobile device. The retention mechanism includes magnets disposed on the head-mounted display housing that attract the magnets of a pair of headphones (e.g., earbuds) connected to the mobile device. Accordingly, the earbuds can be stored on the head-mounted display in a known location.

Thus, a user can find the earbuds while wearing the head-mounted display. The magnets can be recessed into the head-mounted display housing or placed inside the housing. The housing can include a channel configured to receive the earbud wires for cable management. The headphones can be connected to the head-mounted display which receives audio signals from the mobile device via a USB connection.

In at least one embodiment, the head-mounted display assembly includes a display housing, a headphone assembly, a headphone storage region located on the body of the display housing, and a headphone retention mechanism at the headphone storage region. The headphone retention mechanism includes a magnetic element configured to produce a magnetic field that releasably retains the headphone assembly against the headphone storage region when a user positions the headphone assembly in the vicinity of the headphone storage region.

General Description

Many of the details and features shown in the Figures are merely illustrative of particular embodiments of the technology. Accordingly, other embodiments can have other details and features without departing from the spirit and scope of the present technology. In addition, those of ordinary skill in the art will understand that further embodiments can be practiced without several of the details described below. Furthermore, various embodiments of the technology can include structures other than those illustrated in the Figures and are expressly not limited to the structures shown in the Figures. Moreover, the various elements and features illustrated in the Figures may not be drawn to scale.

In the Figures, identical reference numbers identify identical or at least generally similar elements. To facilitate the description of any particular element, the most significant digit or digits of any reference number refer to the Figure in which that element is first introduced. For example, element 110 is first introduced and described with reference to FIG. 1.

Figure 1A:
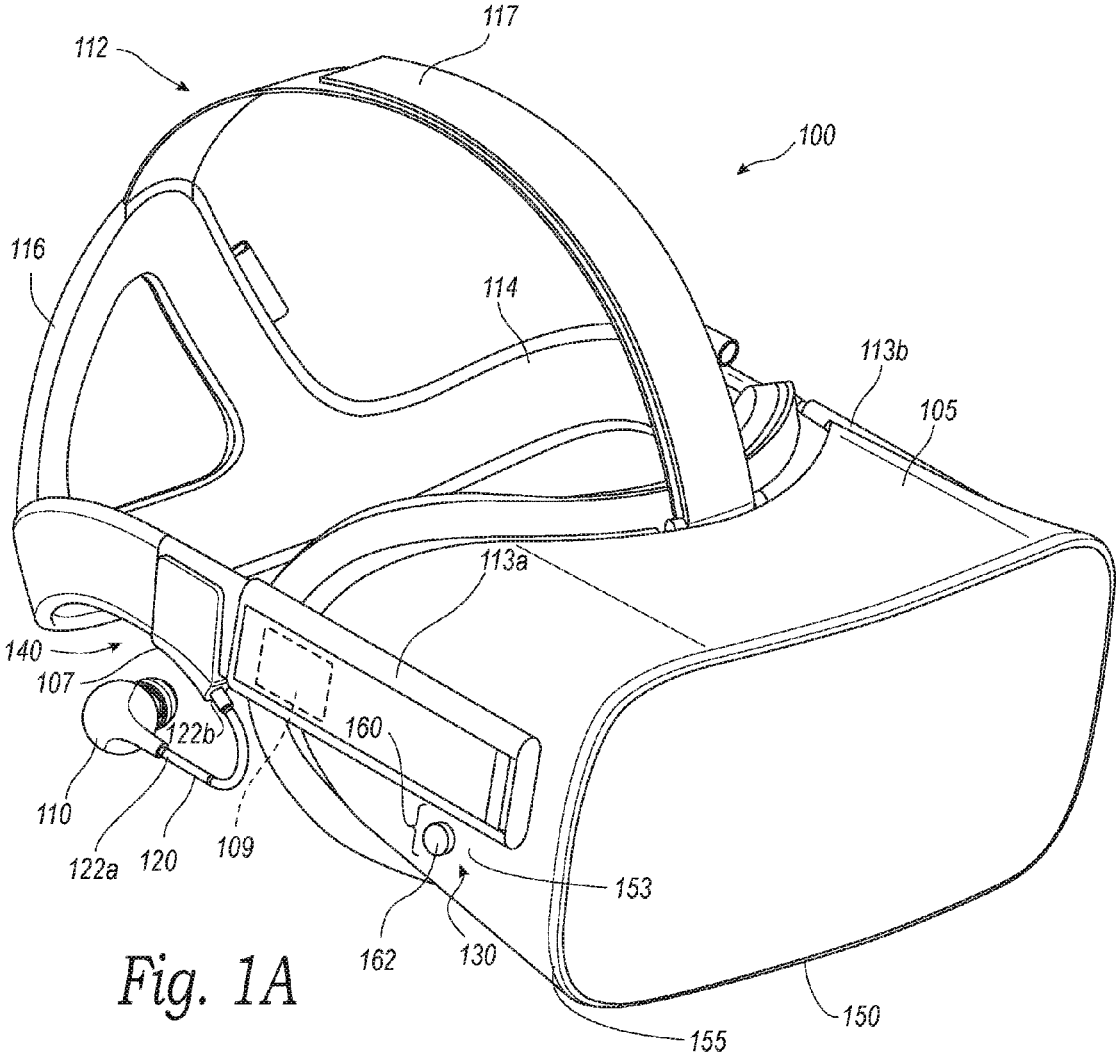
FIG. 1A is an isometric view.
Figure 1B:
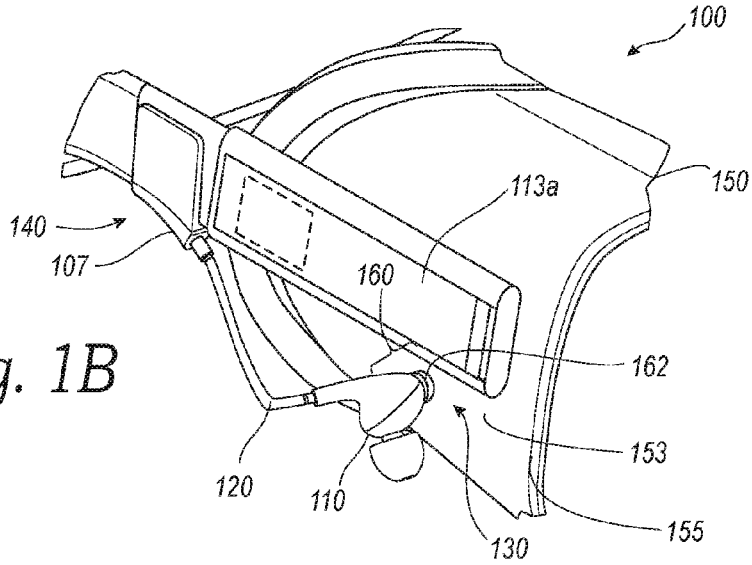
FIG. 1B is a partial isometric view of a headphone retention mechanism incorporated into a head-mounted display system in accordance with an embodiment of the present disclosure.

FIG. 1A is an isometric view of a headphone assembly, or earbud 110, operably to a head mounted display 105 of a head-mounted display system 100 by a flexible audio line or cable, such as a shielded earbud wire 120. FIG. 1B is partial isometric view of the earbud 110 releasably retained against a headphone storage region 130 of the head-mounted system 100 in a stowed position. In one aspect of the various embodiments of the present technology, the headphone storage region 130 provides a location at which the earbud 110 can be stowed when not in use by the user. In a related aspect, the storage region 130 is a convenient location at which the user can readily locate the earbud 110, such as when placing the head-mounted system 100 on the user's head. Stowage of the earbud 110 can also keep it from dangling freely from the earbud wire 120 when not in use. This, in turn, can prevent the earbud 110 and/or or the earbud wire 120 from snagging on objects and inadvertently detaching from a connector attachment region 140 of the head-mounted display system 100.

While described herein in the context of an earbud, headphone assemblies and associated storage regions of the various embodiments can be implemented with other types of headphone speakers, including on-ear headphone speakers, around-ear headphone speakers, over-ear headphone speakers, in-ear headphone speakers, or any other suitable style of speakers. Although not shown due to the perspective, the head-mounted system 100 may have two headphone storage regions located on the left and right sides to provide stowage for corresponding headphone assemblies.

The left and right headphone assemblies can be substantially symmetric and may use substantially symmetric structures.

Referring to FIG. 1A, the head-mounted display system 100 comprises a strap 112 for mounting the head-mounted display 105 on a user's head. In the example of FIG. 1, the strap 112 comprises rigid side segments 113 (identified individually as a first side segment 113*a* and a second side segment 113*b*) and a semi-rigid segment 114 that are coupled to each other to adjustably wrap around side and back portions of the user's head. In some embodiments, the strap 112 comprises a back piece 116 coupled with the semi-rigid segment 114 to rest against the back of the user's head (e.g., around the user's occipital lobe). In some embodiments, the strap 112 comprises a top strap 117 coupled to the back piece 116 and the head-mounted display 105 to adjustably conform to the top of the user's head when the user is wearing the head-mounted display 105.

Each of the side segments 113 can include a hollow portion containing electrical lines 109 (shown schematically), such as wires or flat flexible circuits. The electrical lines 109 can operably connect the earbud wire 120, and hence the earbud 110, to audio or other circuity (not shown) of the head-mounted system 100.

The earbud wire 120 includes a first end portion 122*a* attached to the earbud 110 and a second end portion 122*b* attached to the connector attachment region 140. In the illustrated embodiment, a connection interface plate 107 is located at the connector attachment region 140. The interface plate 107 can be mounted to the respective side segment 113 and operatively connected to the electrical lines 109 in the side segment. In some embodiments, the coupling subsystem includes a coupling subsystem described in U.S. Patent Application No. 62/273,358, title DETACHABLE AUDIO SYSTEM FOR HEAD-MOUNTED DISPLAY, filed on Dec. 30, 2015, which is incorporated herein by reference in its entirety. In other embodiments, the earbud wire 120 can be operably connected via an audio jack (e.g., 3.5 mm jack) that can be inserted into a corresponding audio receptacle, or the earbud wire 120 can be operably connected to a USB connector. In these and other embodiments, the earbud attachment region can be located on the side segment 113 or a display housing 150 of the head-mounted display 105. In another embodiment, the headphone storage region 130 can be on the top portion of display housing 150, particularly when the earbud 110 has a sufficiently long earbud wire 120, or if the earbud 110 is wireless.

A headphone retention mechanism 160 is located at the headphone storage region 130. The headphone retention mechanism 160 includes a magnetic element 162 attached to an exterior surface 153 of a body 155 of the display housing 150. The magnetic element 162 can be secured within the display housing 150 of the head mounted display 105 and positioned just below or extend through the exterior surface 153. Alternatively, the magnetic element 162 can be attached to the exterior surface 153 with an adhesive or other suitable bonding material.

In general, the retention mechanism 160 can include any of a variety of magnetic elements having a size and shape (e.g., a disc, annular, square, or other shape) configured to provide a suitable magnetic field. In some embodiments, the magnetic element 162 can include a rare earth magnet, such as a rare earth disc magnet available from Apex Magnets of 157 RMX Way, Petersburg, W. Va. In some embodiments, the retention mechanism 160 can include multiple magnetic elements to produce a desired magnetic field and/or magnetic force for retaining the earbud 110 against the headphone storage region 130 in the stowed position.

In operation, the magnetic element 162 is configured to provide a magnetic field that interacts with a magnetic field of the speaker (not visible in FIGS. 1A and 1B) within the earbud 110 to produce a magnetic force which can hold the earbud 110 against the headphone storage region 130 when the earbud 110 is placed within its vicinity. The magnetic field of the magnetic element 162 is also selected such that that the earbud 110 can be readily released from the storage region 130 when the user pulls the earbud 110 off of the storage region 130 with a force that overcomes the applied magnetic force.

In some embodiments, the magnetic element 162 can be coated with a plastic material or other suitable material to insulate the metallic surfaces of the magnetic element. In other embodiments, the magnetic element 162 can be positioned elsewhere in the head-mounted display system. For example, in one embodiment the magnetic element 162 can be located on the corresponding side segment 113 of the strap 112.

Figure 2A:
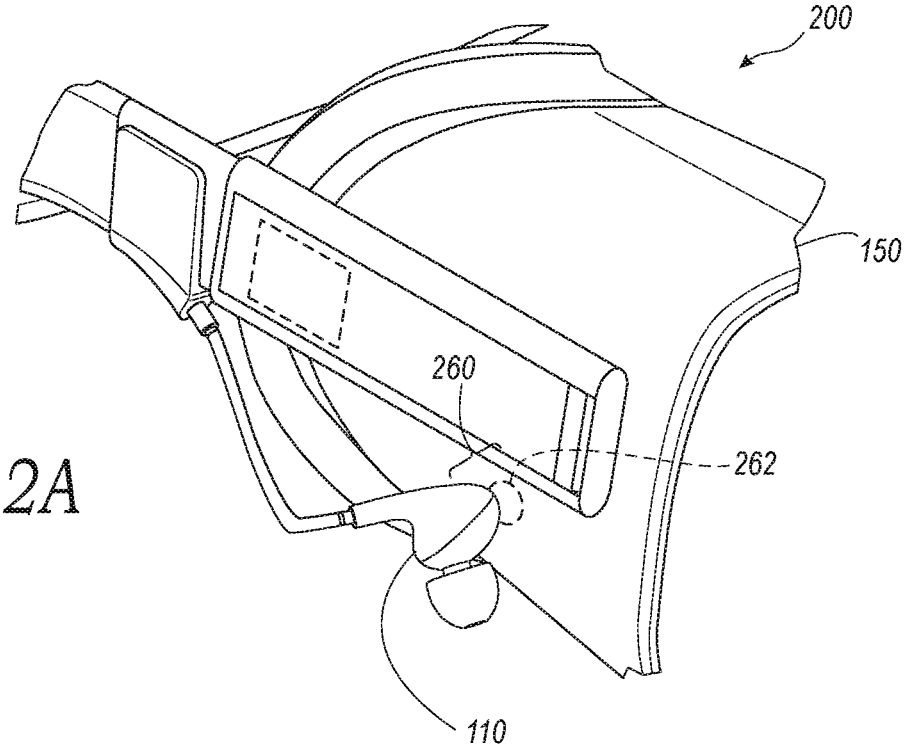
FIG. 2A is a partial isometric view.
Figure 2B:
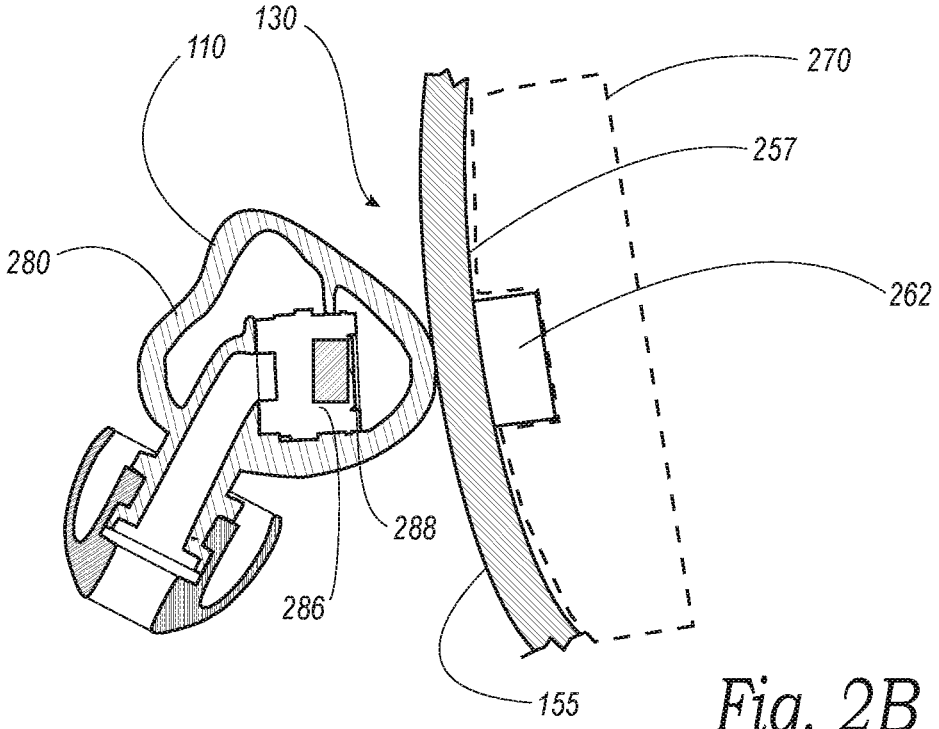
FIG. 2B is a cross-sectional view of a head-mounted display system 100 in accordance with another embodiment of the present technology.

FIG. 2A is a partial isometric view, and FIG. 2B is a cross-sectional view of a head-mounted display system 200 configured in accordance with another embodiment of the present technology. Referring to FIG. 2A, the head-mounted system 200 can be generally similar to the head-mounted system 100 described above with reference to FIGS. 1A and 1B, but includes a headphone retention mechanism 260 having a magnetic element 262 (shown in hidden lines) positioned within the enclosure of the display housing 150.

Referring to FIG. 2B, the magnetic element 262 can be positioned within the display housing body 155 such that it does not interfere with the display components 270 (show schematically) of the head-mounted display 105. In some embodiments, the magnetic element 262 is attached to an interior surface 257 of the display housing body 155 via an adhesive or other suitable bonding material. In additional or alternate embodiments, the display housing body 155 can include integrated attachment features, such as mechanical clips (not shown), that attach the magnetic element 262 to the housing body 155 without an adhesive or bonding material.

In some embodiments, the retention mechanism 260 can include a magnetic element with a greater field strength in cases where the housing body 155 has a relatively large wall thickness. In general, a large wall thickness would tend to attenuate the strength of the magnetic force applied by the magnetic element 262 to the speaker of the earbud 110. Alternately, the retention mechanism 260 can include a magnetic element with a relatively smaller field strength for smaller wall thicknesses.

As further shown in FIG. 2B, the earbud 110 includes a housing 280 containing a speaker 286. The speaker 286 can be a conventional speaker including a magnetic region 288 forming a portion of the speaker transducer. As discussed above, the speaker 286 interacts with the magnetic element 262 of the retention mechanism 260 to retain the earbud 110 against the storage region 130 in the stowed position. The magnetic element 262 can be selected such that is has a field strength for providing a suitable magnetic force based on the field strength of the speaker 286.

Figure 3:
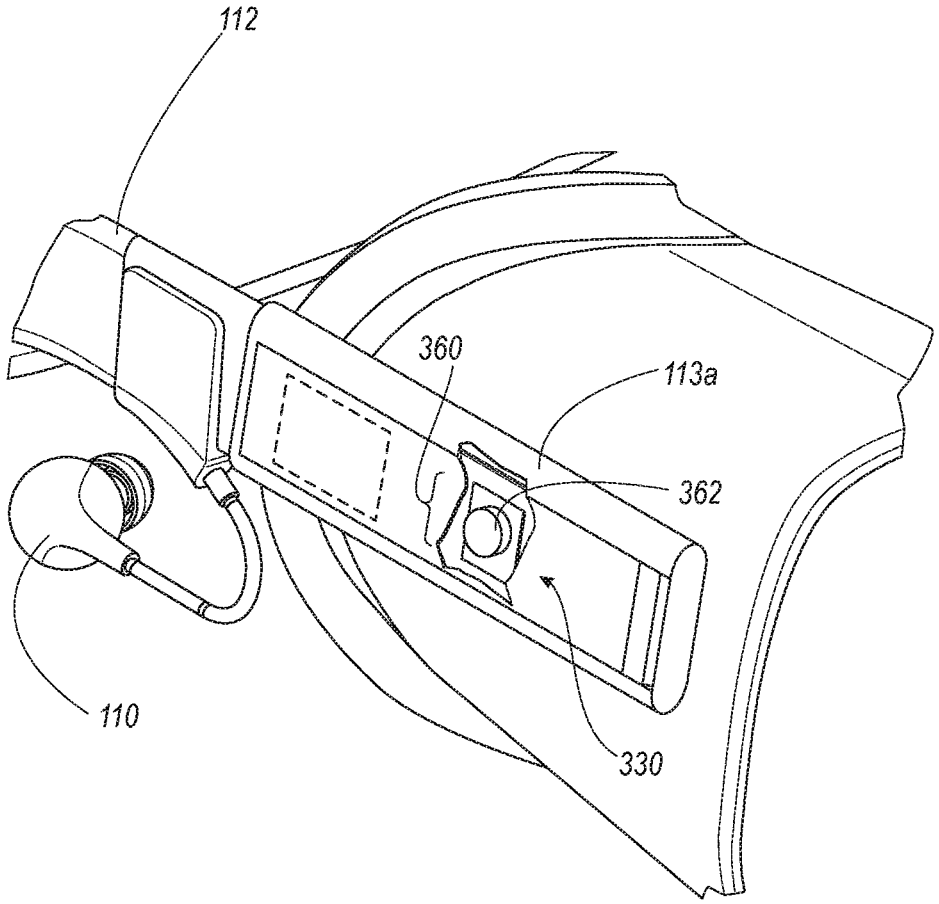
FIG. 3 is a partial, cutaway isometric view of a head-mounted display system in accordance with another embodiment of the present technology.

FIG. 3 is a partial, cutaway isometric view of a head-mounted display system 300 configured in accordance with another embodiment of the present technology. The head-mounted system 300 can be generally similar to the head-mounted systems described above with reference to FIGS. 1A-2B, but includes a headphone retention mechanism 360 having a magnetic element 362 positioned within the enclosure of the side segment 113*a* of the strap 112. In one aspect of this embodiment, the retention mechanism 360 forms an attachment region 330 on the side segment 113*a*.

Figure 4A:
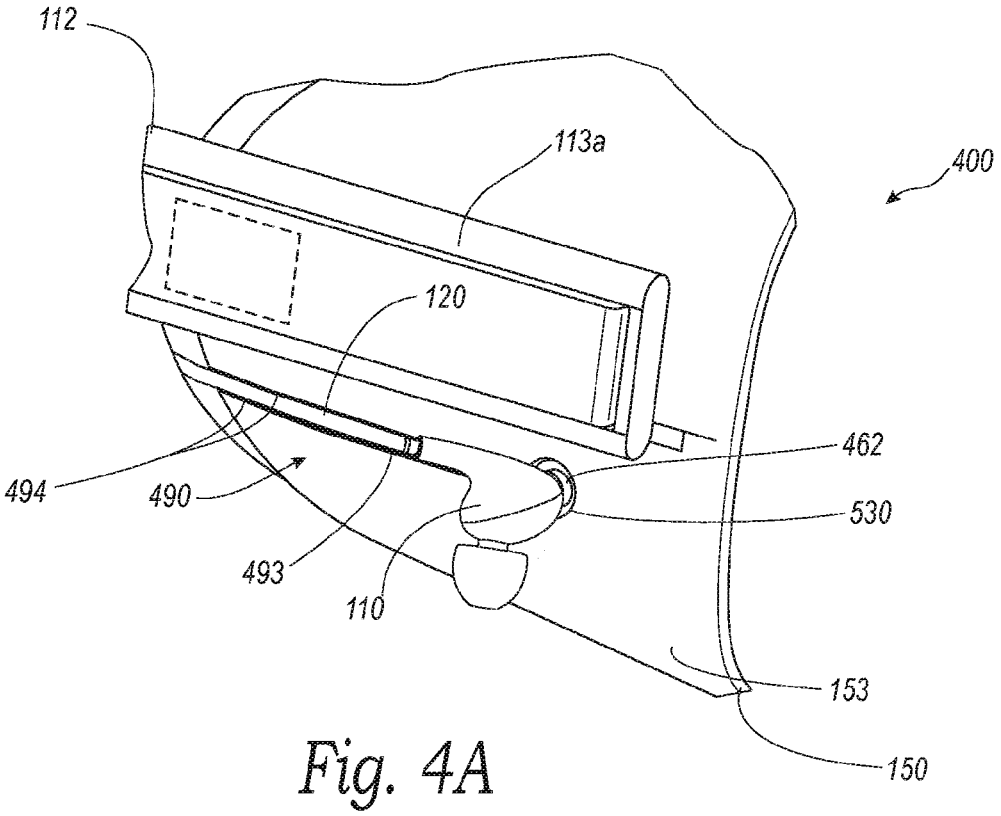
FIGS. 4A and 4B are partial isometric views of a head-mounted display in accordance with another embodiment of the present technology.
Figure 4B:
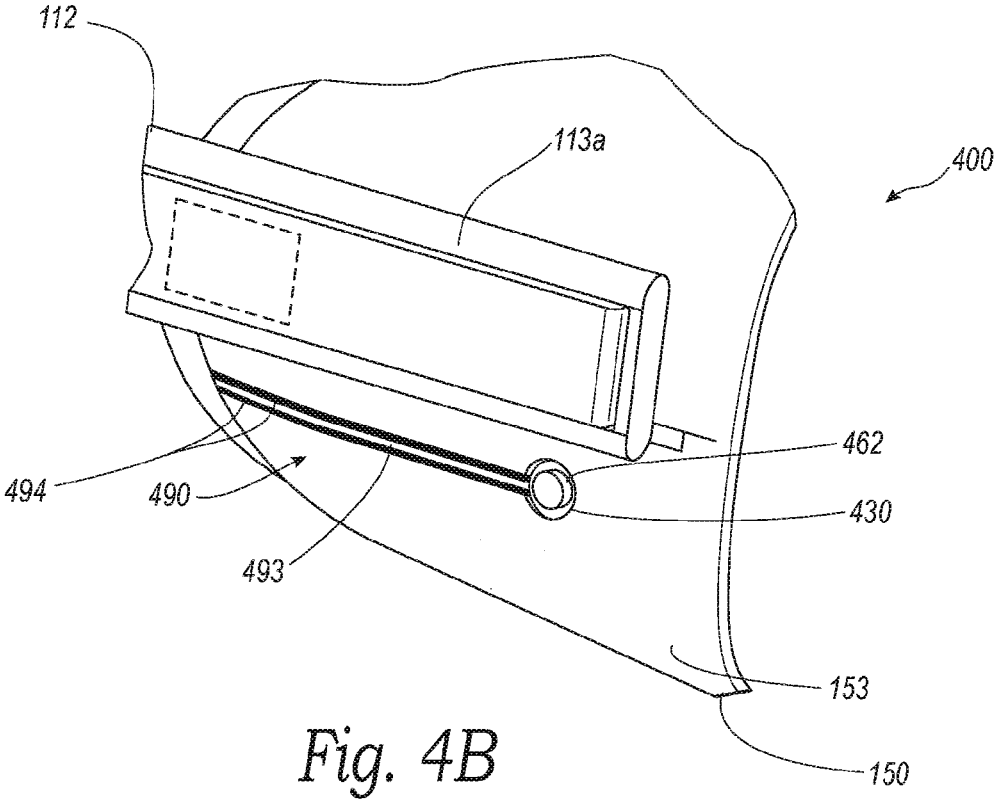

FIG. 4A is partial isometric view of a head-mounted display system 400 showing a connector retention feature 490 and a portion of the earbud wire 120 inserted into the connector retention feature. FIG. 4B is a partial isometric view with the earbud 110 detached from a magnetic element 462 to show the connector retention feature 490 in more detail. Referring to FIGS. 4A and 4B together, the connector retention feature 490 includes a channel 493 formed in the exterior surface 173 of the display housing 150. The channel 493 extends along the side segment 113*a* of the strap 112 and is lined with a flexible material 494 that partially fills the channel 493. The flexible material 494 can include, for example, a thin-film coating, a rubber overmold, or other relatively soft material configured to snugly hold the earbud wire 120 when inserted into the channel 493. Referring to FIG. 4B, the channel 493 can open to a recess 430 formed in the exterior surface 153 of the display housing 150 and into which the magnetic element 462 is inserted.

Figure 5A:
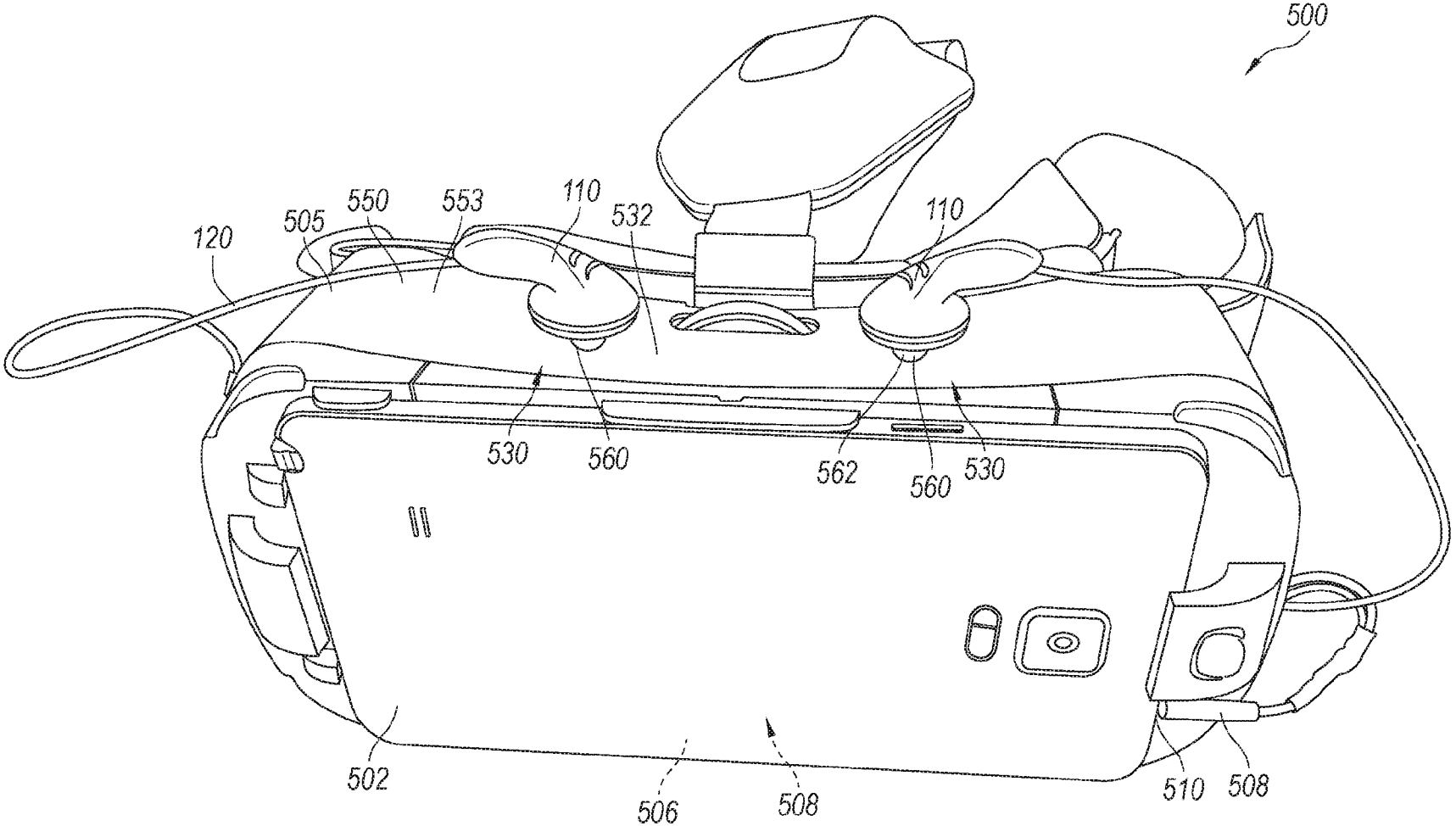
FIG. 5A is a top front isometric view and FIG. 5B is a bottom isometric view of a head-mounted display in accordance with another embodiment of the present technology.
Figure 5B:
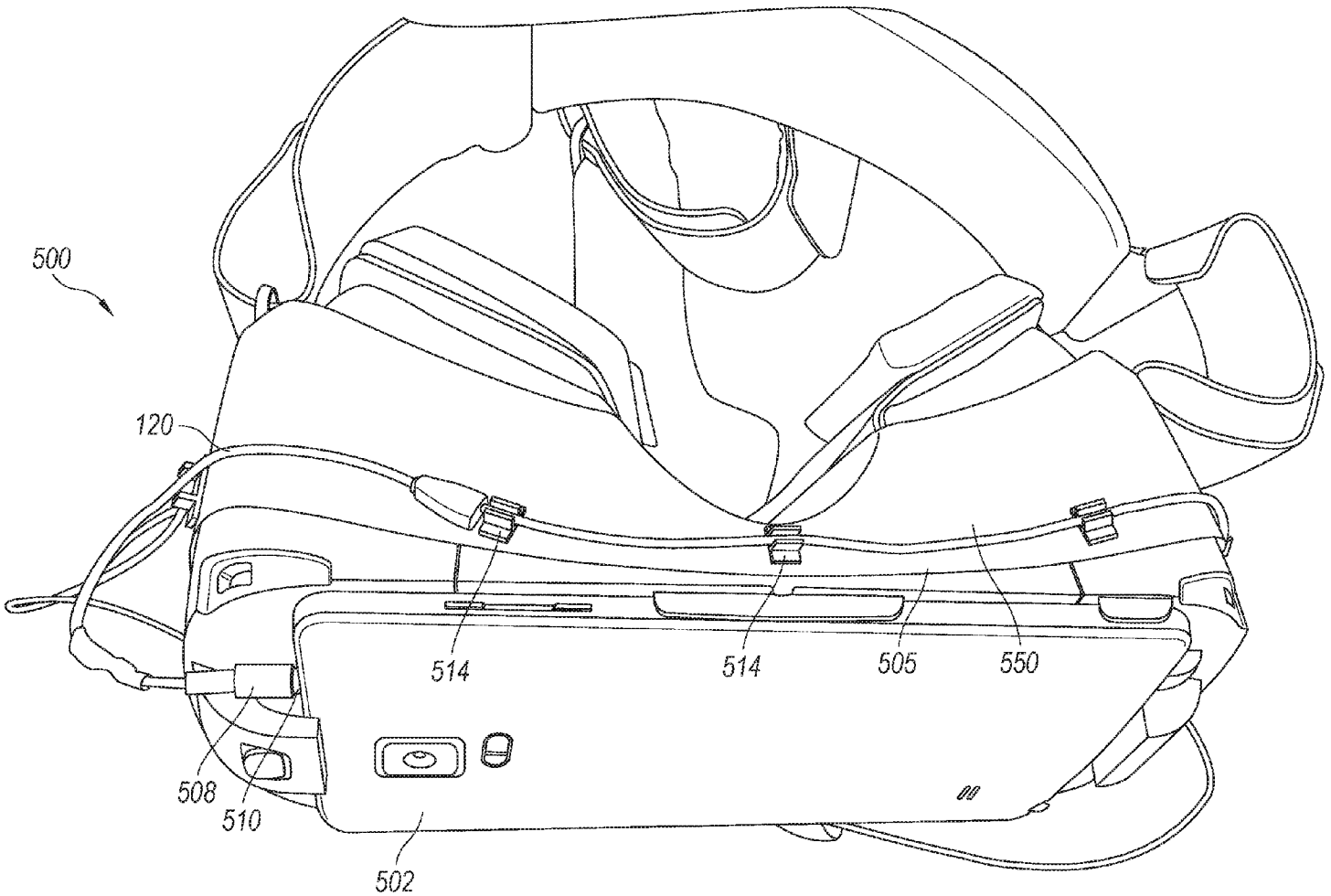

FIG. 5A is a top isometric view of a head-mounted display system 500 in accordance with another embodiment of the present technology, and FIG. 5B is a bottom isometric view of the head-mounted display system 500. In this embodiment, the head-mounted display system 500 has a head-mounted display 505 with a display housing 550 configured to removably receive a cell phone 502 on a front portion of the housing, such that the cell phone's display screen faces inwardly toward optics within the display housing 550. Accordingly, when a user is wearing the head-mounted display 505, the user can look through the optics and see images displayed on the cell phone's display screen 506, such as is described in greater detail in U.S. patent application Ser. No. 14/961,832, titled Head Mounted Display Housing, filed Dec. 7, 2015, which is incorporated herein in its entirety by reference thereto. Although the illustrated embodiment shows the display housing 550 carrying a cell phone, other embodiments can include display housings 550 that carry other mobile devices or display devices.

In the illustrated embodiment the earbuds 110 are connected to the earbud wires 120, which connect to an audio jack 508 (e.g., 3.5 mm jack) that releasably plugs into the jack receptacle 508 of the cell phone 502. The display housing 550 has the earbud storage region 530 on the housing's top panel 532, and magnetic elements 526 of the earbud retention mechanism 560 project upwardly away from the top panel's exterior surface 553. In other embodiments, the magnetic elements 526 may be flush with the top panel's exterior surface 553, or the magnetic elements 526 may be below the exterior surface 553, while still providing the magnetic field that hold the earbuds 110 to the earbud storage region.

As seen in FIG. 5B, the head-mounted display 505 has a plurality of wire retainers 514 attached to the display housing 550 that removably receive the portion of the earbud wires 120 between the audio jack 508 and the earbuds 110. The wire retainers 514 are configured to provide wire management for the earbud wire 120 by retaining the earbud wire along exterior of the display housing 550, thereby minimizing the excess earbud wire hanging from the housing. In the illustrated embodiment, the wire retainers 514 are flexible clips adhered to the exterior of the display housing 550 that allow for quick and easy insertion or removal of the earbud wire 120 to or from the clips. In other embodiments, the wire retainers 514 can be integrally connected to or formed within selected portions of the display housing 550. In yet other embodiments, the wire retainers 514 may be removably attached to the display housing 550.

The foregoing description, for purpose of explanation, has been described with reference to specific embodiments. However, the illustrative discussions above are not intended to be exhaustive or to limit the scope of the claims to the precise forms disclosed. Many modifications and variations are possible in view of the above teachings. The embodiments were chosen in order to best explain the principles underlying the claims and their practical applications, to thereby enable others skilled in the art to best use the embodiments with various modifications as are suited to the particular uses contemplated.

The invention claimed is:

1. A head-mounted display assembly, comprising:
- a display housing having a body defining an enclosure that contains display components;
- a headphone assembly housing a speaker;
- a headphone storage region located on the body of the display housing; and
- a headphone retention mechanism at the headphone storage region, the headphone retention mechanism including a magnetic element configured to produce a magnetic field that releasably retains the headphone assembly against the headphone storage region when a user positions the headphone assembly in the vicinity of the headphone storage region.

2. The head-mounted display assembly of claim 1 wherein the body of the display housing includes an exterior surface outside of the enclosure, and wherein the magnetic element is attached to the exterior surface.

3. The head-mounted display assembly of claim 1 wherein the body of the display housing includes:
- an exterior surface outside of the enclosure; and
- a recess formed in the exterior surface, wherein the magnetic element is positioned within the recess.

4. The head-mounted display assembly of claim 1 wherein the body of the display housing includes an interior surface within the enclosure, and wherein the magnetic element is attached to the interior surface.

5. The head-mounted display assembly of claim 1, further comprising:
- a flexible electrical connector having a first end portion attached to the headphone assembly, and a second end portion attached to a connector attachment region of the headphone assembly;
- a connector retention feature proximate the headphone storage region and configured to receive a portion of the flexible electrical connector.

6. The head-mounted display assembly of claim 5 wherein:
- the body of the display housing includes an exterior surface outside of the enclosure; and
- the connector retention feature includes a channel formed in the exterior surface and into which the portion of the flexible electrical connector is received.

7. The head-mounted display assembly of claim 6, further comprising a flexible material filling a portion of the channel of the connector retention feature, wherein the flexible material is configured to snugly hold the portion of the flexible electrical connector when received into the channel.

8. The head-mounted display assembly of claim 6 wherein the body of the display housing further includes a recess formed in the exterior surface, wherein the magnetic element of the headphone retention mechanism is positioned with the recess, and wherein the channel of the connector retention feature opens to the recess.

9. The head-mounted display assembly of claim 1 wherein the magnetic element comprises a rare earth magnet.

10. A head-mounted display assembly, comprising:

a display housing;

a headphone assembly housing a speaker;

a flexible electrical connector having a first end portion attached to the headphone assembly and a second end portion configured to operably couple the headphone assembly to a connector attachment region of the head-mounted display assembly;

a headphone storage region adjacent the display housing; and a headphone retention mechanism at the headphone storage region, wherein the retention mechanism includes a magnetic element, wherein the magnetic element is configured to produce a magnetic field that interacts with a magnetic field of the speaker to produce a magnetic force that (1) retains the headphone assembly against the headphone storage region when a user places the headphone assembly within a vicinity of the magnetic element and (2) allows the headphone assembly to be released from the headphone storage region when a user pulls the headphone assembly off of the headphone storage region with a force that overcomes the magnetic force.

11. The head-mounted display assembly of claim 10, further comprising a strap assembly attached to the display assembly, wherein the headphone storage region is adjacent the strap assembly.

12. The head-mounted display of claim 11 wherein the magnetic element of the retention mechanism is attached to the strap assembly.

13. The head-mounted display assembly of claim 10, further comprising a strap assembly attached to the display assembly, wherein the magnetic element of the retention mechanism is positioned on the strap assembly.

14. The head-mounted display assembly of claim 10 wherein the magnetic element of the retention mechanism is contained within the strap assembly.

15. A head-mounted display assembly, comprising:

a display housing having a body defining an enclosure that contains display components;

an earbud containing a speaker;

a flexible wire configured to operably couple the earbud to a wire attachment region of the head-mounted display assembly;

a strap assembly attached to the body of the display housing;

an earbud storage region proximate the strap assembly and/or the body of the display housing; and an earbud retention mechanism at the earbud storage region, the earbud retention mechanism including a magnetic element configured to releasably hold the earbud against the earbud storage region by virtue of magnetic attraction between the magnetic element and the speaker contained in the earbud.

16. The head-mounted display assembly of claim 15 wherein the strap assembly includes an attachment portion that attaches the display housing to the strap assembly, and wherein the head-mounted display assembly includes a wire retention feature proximate the strap assembly and configured to receive a portion of the flexible wire.

17. The head-mounted display assembly of claim 15 wherein the wire retention feature includes a channel integrally formed in the display housing and into which the portion of the flexible wire is received.

18. The head-mounted display assembly of claim 15 wherein the channel extends along a portion of the strap assembly.

19. The head-mounted display assembly of claim 15 wherein the magnetic element of the earbud retention mechanism is positioned within the enclosure of the display housing.

20. The head-mounted display assembly of claim 15 wherein the magnetic element of the earbud retention mechanism is contained within the strap assembly.

* * * * *